US005881806A

United States Patent [19]

Rudd

[11] Patent Number: 5,881,806

[45] Date of Patent: Mar. 16, 1999

[54] AIR DISTRIBUTION FAN AND OUTSIDE AIR DAMPER RECYCLING CONTROL

[75] Inventor: Armin Rudd, Cocoa, Fla.

[73] Assignee: University of Central Florida, Orlando, Fla.

[21] Appl. No.: 912,664

[22] Filed: Aug. 18, 1997

[51] Int. Cl.[6] ..... F25B 19/00; F24F 7/00

[52] U.S. Cl. ..... 165/244; 62/231; 165/250; 454/201

[58] Field of Search ..... 62/231, 179; 165/244, 165/249, 250

[56] References Cited

U.S. PATENT DOCUMENTS

| | | | |
|---|---|---|---|
| 2,107,268 | 2/1938 | Avery et al. | 165/250 |
| 2,495,861 | 1/1950 | Newton | 257/3 |
| 2,882,383 | 4/1959 | Boyd | 219/39 |
| 3,635,044 | 1/1972 | Heth | 62/157 |
| 3,948,438 | 4/1976 | Vlasak | 236/9 |
| 4,011,735 | 3/1977 | Martz et al. | 62/186 |
| 4,075,864 | 2/1978 | Schrader | 62/180 |
| 4,136,822 | 1/1979 | Felter | 236/49 |
| 4,356,962 | 11/1982 | Levine | 236/11 |
| 4,369,916 | 1/1983 | Abbey | 236/11 |
| 4,408,711 | 10/1983 | Levine | 236/11 |
| 4,449,375 | 5/1984 | Briccetti | 62/89 |
| 4,467,617 | 8/1984 | Morgan, Jr. et al. | 62/180 |
| 4,502,625 | 3/1985 | Mueller | 236/11 |
| 4,595,139 | 6/1986 | Levine | 236/44 |
| 4,684,060 | 8/1987 | Adams et al. | 236/11 |
| 4,718,021 | 1/1988 | Timblin | 364/505 |
| 4,838,482 | 6/1989 | Vogelzang | 236/11 |
| 4,930,460 | 6/1990 | Aihara et al. | 723/41.49 |
| 4,951,473 | 8/1990 | Levine et al. | 62/82 |
| 5,020,332 | 6/1991 | Nakatsuno et al. | 62/157 |
| 5,239,834 | 8/1993 | Travers | 62/151 |
| 5,241,253 | 8/1993 | Schlangen | 318/779 |
| 5,547,017 | 8/1996 | Rudd | 165/244 |
| 5,582,233 | 12/1996 | Noto | 62/180 |

FOREIGN PATENT DOCUMENTS 61-8544 6/1984 Japan .

OTHER PUBLICATIONS

Honeywell, Inc., "Perfect Climate Comfort Center Control System", Product Data 1995, pp. 1–58.

Honeywell, Inc., "Perfect Climate Comfort Center", Owner's Guide, 1995, pp. 1–49.

Honeywell, Inc., "Introducing the Honeywell Perfect Climate Control System", Product Brochure, 1996, pp. 1–6.

Wild Rose Controls, Inc., "Control Improves Efficiency of Forced–Air Systems, New or Old", Air Conditioning, Heating & Refrigeration News, Mar. 2, 1998, p. 3.

*Primary Examiner*—William Wayner

*Attorney, Agent, or Firm*—Law Offices of Brian S. Steinberger; Brian S. Steinberger

[57] ABSTRACT

A system for controlling the operation of an air distribution fan and the operation of a motorized outside air damper of an air conditioning system, having heating and/or cooling and/or humidifying and/or dehumidifying operating modes. The system includes a fan recycling control for periodically energizing and de-energizing an air distribution fan in an air conditioning system in order to operate the air distribution fan for a first selectable time period after a second selectable time period from the end of the last operation of the air distribution fan. The last operation of the air distribution fan could have been due to the heating or cooling or humidifying or dehumidifying or constant fan modes of the air conditioning system, or due to fan operation initiated by the fan recycling control. The system includes an outside air damper recycling control that can open a motorized outside air damper, for the purpose of drawing in ventilation air, each time the air distribution fan operates, and for as long as the air distribution fan continued to operate, can cycle, periodically close then open, the outside air damper based on selectable time periods since it was last opened or closed, respectively. The outside air damper recycling control can de-energize the motorized outside air damper at the end of each operation of the air distribution fan.

14 Claims, 5 Drawing Sheets

AIR DISTRIBUTION FAN AND OUTSIDE AIR DAMPER RECYCLING CONTROL

This invention relates to distributing outside ventilation air in an interior space or mixing air in an interior space, and in particular to a control that operates the air distribution fan of an air conditioning system dependent on the last operation of the fan, and operates an outside air damper in an outside air duct of an air conditioning system dependent on the operating time of the air distribution fan. This application is related to U.S. patent application Ser. No. 08/369,180 filed on Jan. 5, 1995 and now issued as U.S. Pat. No. 5,547,017, which is incorporated as reference.

BACKGROUND AND PRIOR ART

Air conditioning systems for residential buildings, having heating and/or cooling and/or humidifying and/or dehumidifying and/or air-cleaning modes, for conditioning air, normally operate the system air distribution fan only when the air conditioning system is operating to condition air. Alternatively, the air distribution fan of an air conditioning system can be operated constantly. However, such a constant running of the fan would constitute a waste of energy and power, and could cause moisture related problems in warm, humid climates.

In air conditioning systems, a heating and/or cooling and/or humidifying and/or dehumidifying and/or air-cleaning apparatus produces conditioned air. Normally, the conditioned air is distributed by a fan or blower through various ducts throughout an interior space in order to place the conditioned air at desirable locations. Generally, thermostats or humidistats are used to activate the conditioning apparatus. For example, when the air temperature within an interior space drops below a selected level, an air temperature sensor and switch in a thermostat can activate a heating apparatus and an air distribution fan. Likewise, when the air temperature within an interior space rises above a selected level, an air temperature sensor and switch in a thermostat can activate a cooling apparatus and an air distribution fan. Likewise, when the air humidity within an interior space drops below a selected level, an air humidity sensor and switch in a humidistat can activate a humidifying apparatus and an air distribution fan. Likewise, when the air humidity within an interior space rises above a selected level, an air humidity sensor and switch in a humidistat can activate a dehumidifying apparatus and an air distribution fan. The conditioning apparatus and air distribution fan are deactivated when the interior space temperature or humidity reaches the selected level. In some air conditioning systems, while in the heating mode, the air distribution fan may continue to run after the heating apparatus has been deactivated, usually until residual heat in the heating apparatus has been removed by the circulating air. Likewise, in some air conditioning systems, while in the cooling mode, the air distribution fan may continue to run after the cooling apparatus has been deactivated, usually for a preset delay time to continue to distribute cool air while the cooling apparatus is still cold. In warm, humid climates, this running of the air distribution fan immediately after the cooling/dehumidifying apparatus has been deactivated is counterproductive, in that, moisture on the wet cooling/dehumidifying apparatus is returned to the interior space by the circulating air. However, no known control systems exist having means to periodically operate the air distribution fan for a first selectable time period after a second selectable time period from the end of the last operation of the air distribution fan, that is, operate the fan dependent on the last operation of the fan.

Prior art related to the air distribution fan recycling control portion of the present invention is cited but was not found to overcome the problems cited above. See for example, U.S. Pat. Nos. 2,882,383 to Boyd Jr. et al.; 3,454,078 to Elwart; 4,167,966 to Freeman; 4,267,967 to Beck et al.; 4,452,391 to Chow; 4,718,021 to Timblin; 4,773,587 to Lipman; 5,131,236 to Wruck et al.; 5,179,524 to Parker et al.; 5,325,286 to Weng et al.; and Japanese Patents 0095538 and 0008544. U.S. Pat. No. 4,838,482 to Vogelzang describes an air conditioning system with periodic fan operation. However, this device is limited to periodic cycling of the air distribution fan during periods when the activation of a heating or cooling apparatus has been locked out. Vogelzang '482 describes a fan cycle mode, selected on a thermostat, that energizes a switch that turns the fan on and off a "predetermined number of times each hour" such as "6" times per hour. When this fan cycle mode is selected, the heating or cooling modes cannot be activated, since the operation of the heating and cooling apparatus require non-cycling, constant, operation of the air distribution fan. If operation of the heating or cooling apparatus is desired, the fan cycling mode must be manually de-selected. The Vogelzang '482 fan cycling system is not dependent upon the last operation of the fan nor dependent on the last operation of the heating or cooling apparatus. In fact, Vogelzang '482 specifically claims that the fan cycling is "independent" of the operation of the heating or cooling apparatus. Whereas, prior U.S. Pat. No. 5,547,017 to Rudd, the same inventor of the subject invention, requires recycling of the air conditioning system air distribution fan "where the periodic ON/OFF control of the fan is dependent on the time since the last fan operation." A signal from the thermostat to operate the heating or cooling or constant fan modes will automatically interrupt the fan recycling. Rudd '017 can determine the selectable time delay based on the volume dimensions of the rooms and/or the number of occupants.

In air conditioning systems, an outside air duct connecting between the outside of an interior space and the return air side of an air distribution fan, for the purpose of drawing in ventilation air, is known. Often, motorized dampers are placed in the outside air duct to limit outside air entry to times when the air distribution fan is operating. Motorized outside air dampers are known and exist commercially. It is known to energize an outside air damper upon energizing an air distribution fan, and it is known to de-energize a damper upon de-energizing an air distribution fan. However, no known control systems exist to first open an outside air damper upon energizing an air distribution fan, then for as long as the fan continues to operate, to periodically close and open the outside air damper based on selectable time periods since the outside air damper was last opened or closed, respectively, then to close the outside air damper at the end of each operation of the air distribution fan. In this way, the subject invention would control the outside air damper position dependent on the operating time of the air distribution fan, and allow a limit to be placed on the amount of outside air to be drawn in when the air distribution fan is operating.

Standards enacted in 1989 by the American Society of Heating, Refigeration and Air Conditioning Engineers (ASHRAE) such as the ASHRAE 62–89 Standard now require 15 cubic feet per minute of outside air per person in residential dwellings, which can result in approximately 0.35 air changes per hour. The ASHRAE 62–89 Standard further includes a recommendation to limit the concentration of carbon dioxide to 1000 parts per million to control indoor air quality due to respiration.

The Manufactured Home Construction and Safety Standards set forth by the U.S. Department of Housing and Urban Development (HUD) has enacted standards for manufactured homes that require fresh air ventilation systems. These ventilation systems must distribute outdoor air throughout the conditioned living space. Some ventilation systems require the installation of supply ducts separate from those of the air conditioning system, to distribute ventilation air. The separate ventilation supply ducts are potentially an unnecessary additional expense.

SUMMARY OF THE INVENTION

The primary objective of the present invention is a fan recycling control system for using the existing air distribution fan and ducts of an air conditioning system, having heating and/or cooling and/or humidifying and/or dehumidifying operating modes, for the periodic distributing of ventilation air and mixing of air throughout the interior air space served by the air conditioning system while the air distribution fan is not operating due to lack of a positive signal from the thermostat or humidistat for heating or cooling or humidifying or dehumidifying or constant fan modes.

The fan recycling control provides a means for operating the air distribution fan for a first selectable time period after a second selectable time period from the end of the last operation of the air distribution fan, where the last operation of the air distribution fan could have been due to a positive signal from the thermostat or humidistat for heating or cooling or humidifying or dehumidifying or constant fan modes of the air conditioning system, or due to fan operation initiated by the fan recycling control. The present invention includes an outside air damper recycling control having a means to open a motorized outside air damper, for the purpose of drawing in ventilation air, each time the air distribution fan operates, and for as long as the air distribution fan continues to operate, having a means to cycle, periodically close then open, the outside air damper based on selectable time periods since it was last opened or closed, respectively, and having a means to cause the motorized outside air damper to close at the end of each operation of the air distribution fan.

The fan recycling control and outside air damper recycling control can be effective on many different types of air conditioning systems. For example, the invention can be equally applied to a cooling only air conditioning system for cooling and dehumidifying, a cooling air conditioning system with electric beat for cooling and dehumidifying and heating, a heat pump air conditioning system for cooling and dehumidifying and heating, a gas or oil furnace system with or without a humidifier for heating and humidifying, and any combination of these systems.

Further objects and advantages of the present invention will be apparent from the following detailed description of a presently preferred embodiment which is illustrated in the accompanying drawings.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation. This invention incorporates by reference U.S. Pat. No. 5,547,017 to Rudd, the same inventor of the subject invention.

First Embodiment

Figure 1:
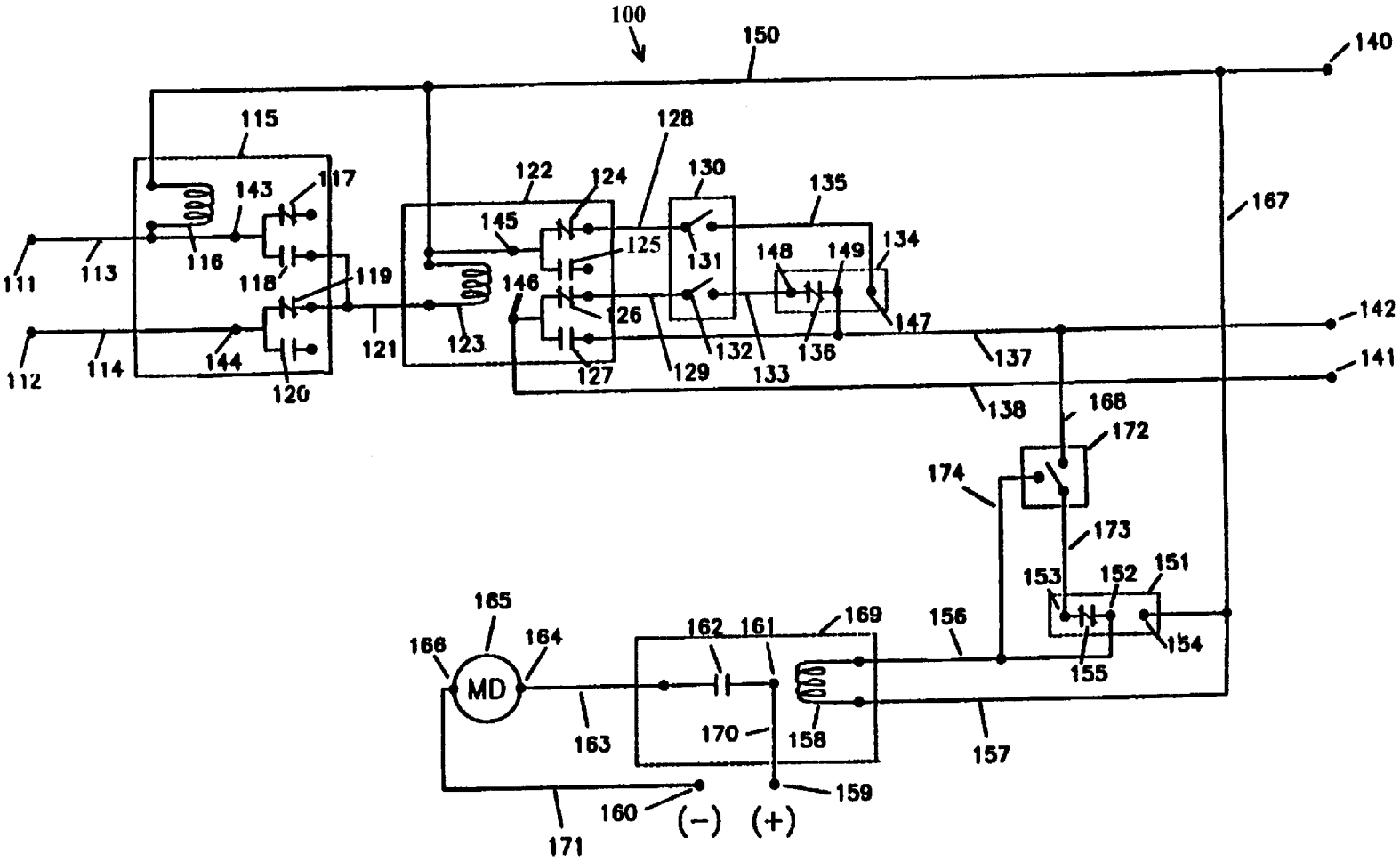
FIG. 1 is a first preferred embodiment of a schematic of the subject invention showing a stand-alone unit with electro-mechanical relays with solid-state recycling timer units.

FIG. 1 is a first preferred embodiment of the present invention 100 showing a stand-alone control unit, first-put-to-practice embodiment, based on electro-mechanical relays with solid-state recycling timer units. The components of FIG. 1 will now be described.

Referring to FIG. 1, component 111 is the fan control terminal of the thermostat or humidistat. Component 112 is the heat control terminal of the thermostat. Component 113 is the wire connecting terminal 111 to the power input side of the 24 Vac relay coil 116, and pole 1, 143, of the double-pole double-throw (DPDT) relay 115. Component 114 is the wire connecting terminal 112 to pole 2, 144, of the DPDT relay 115. Component 121 is the wire connecting the normally open (NO) contact 118, of pole 1, 143, and the normally closed contact (NC) 119, of pole 2, 144, to the power input side of the 24 Vac relay coil 123, of the DPDT relay 122. NO contact 118, and NC contact 120, of DPDT relay 115, are not used. Component 128 is the wire connecting NC contact, 124, of pole 1, 145, to switch 131, of double-pole single-throw (DPST) switch 130. Component 129 is the wire connecting NC contact 126, of pole 2, 146, to switch 132, of DPST switch 130. NO contact 118, and NC contact 120, of DPDT relay 122, are not used. Component 133 is the wire connecting switch 132, to the power input terminal 148, of the solid-state recycling timer 134. Component 135 is a wire connecting switch 130, to the common input terminal 147, of solid-state recycling timer 134. Component 136 is a switch in the solid-state recycling timer 134, between the power input terminal 148, and the switched output terminal 149. Component 137 is a wire connecting switched output terminal 149, and NO contact 127, to the fan relay terminal 142, of the air conditioning system air distribution fan. Component 138 is a wire connecting pole 2,146, of DPDT relay 122, to the 24 Vac power terminal 141, of the air conditioning system power supply. Component 150 is a wire connecting the common side of 24 Vac relay coils, 116 and 123, to the common terminal 140, of the 24 Vac power supply of the air conditioning system. Component 167 is a wire connecting common terminal 140, to the common input terminal 154, of the solid-state recycling timer 151. Component 168 is a wire connecting fan relay terminal 142, to the single pole double throw switch (SPDT), 172. Component 174 is a wire connecting the SPDT switch 172 to the power input side of the 24 Vac relay coil 158. Component 173 is a wire connecting the SPDT switch 172, to the power input terminal 153, of the recycling timer 151. Component 155 is a switch in the solid-state recycling timer 151, between the power input terminal 153, and the switched output terminal 152. Component 156 is a wire connecting switched output terminal 152, and the power input side of the 24 Vac relay coil 158, of the single-pole single-throw (SPST) relay 169. Component 157 is a wire connecting the common terminal 140, to the common input side of the 24 Vac relay coil 158. Component 170 is a wire connecting the power terminal 159, of the 24 Vac or nominal 110 Vac power supply for the motorized damper 165, to the pole 161, of the SPST relay 169. Component 163 is a wire connecting the NO contact 162, to the power input terminal of the motorized damper 165. Component 171 is a wire connecting the common terminal 160, of the 24 Vac or nominal 110 Vac power supply, to the common input terminal 166, of the motorized damper 165.

The operation of the components of FIG. 1 will now be described. Referring to FIG. 1, the present invention is wired in series between the thermostat or humidistat fan control terminal 111, and the fan relay terminal 142, of the air conditioning system air distribution fan, and the present invention is wired in parallel with the thermostat heat control terminal 112. When the fan control terminal 111, is energized, the 24 Vac relay coil 116, closes normally open (NO) contact 118, and opens normally closed (NC) contact 119, which energizes the 24 Vac relay coil, 123 and blocks current flow back to the thermostat heat control terminal 112. When the thermostat heat control terminal 112, is energized, the 24 Vac relay coil 116, remains de-energized and the 24 Vac relay coil 123, is energized through NC contact 119, while NO contact, 118 blocks current flow back to the fan control terminal 111. When either the fan control terminal 111, or the thermostat heat control terminal 112, are energized, the line 121 is energized, and the 24 Vac relay coil 123, is energizes, which closes NO contact 127, which energizes the fan relay terminal 142, of the air conditioning system air distribution fan. At the same time, NC contacts 124 and 126, are opened which de-energizes and resets the solid-state recycling timer 134. When both the fan control terminal 111, and the thermostat heat control terminal 112, are de-energized, the line 121 is de-energized, and the 24 Vac relay coil 123, is de-energized, which opens the NO contact 127, cutting off current flow to the fan relay terminal 142. At the same time, NC contacts 124 and 126, close, which energizes the solid-state recycling timer 134. While the recycling timer 134, is energized, the timer will continuously cycle through a preselected OFF delay, during which time the switched output terminal 149, and fan relay terminal 142, are de-energized, and a preselected ON delay, during which time the switched output terminal 149, and fan relay terminal 142, are energized. If the double-pole double throw (DPDT ) switch 130, is switched in the off position, the recycling timer 134, will remain de-energized continuously, while fan control signals from the thermostat or humidistat, through fan control terminal 111, will continue operate the fan relay terminal 142, normally. When line 137 is energized, current will flow to the power input terminal 153, of the solid-state recycling timer 151, which will energize the recycling timer. While the recycling timer 151, is energized, the timer will continuously cycle through a preselected ON delay, during which time the switched output terminal 152, and the 24 Vac relay coil 158, are energized, and a preselected OFF delay, during which time the switched output terminal 152, and the 24 Vac relay coil 158, are de-energized. While the 24 Vac relay coil 158, is energized, the NO contact 162, of the single-pole single-throw (SPST) relay 169, will close, energizing and opening the motorized damper 165. While the 24 Vac relay coil 158, is de-energized, the NO contact 162, will open, de-energizing and closing the motorized damper 165.

Second Embodiment

Figure 2:
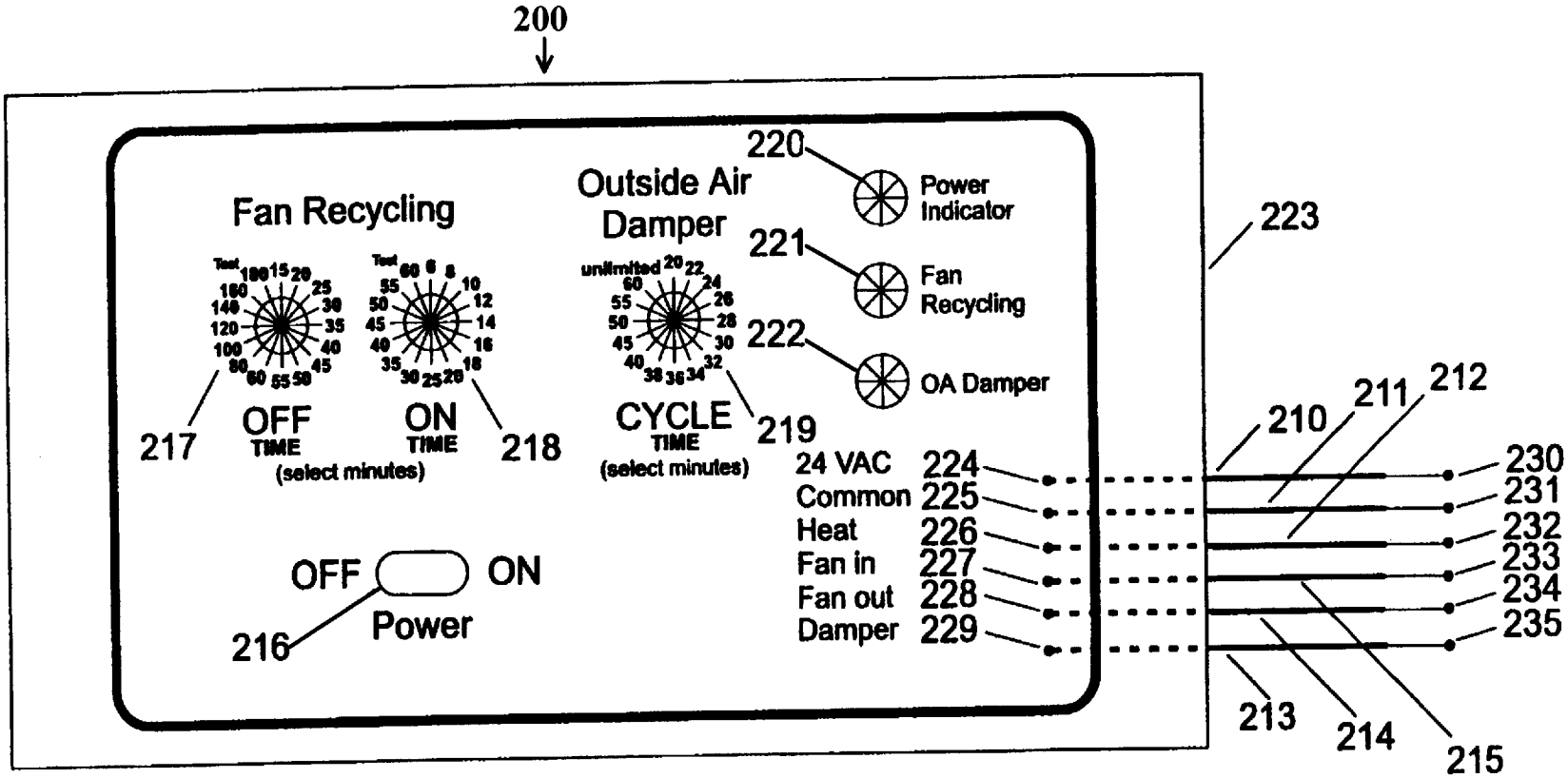
FIG. 2 is a second preferred embodiment showing the external face of a stand-alone unit incorporating the subject invention.

FIG. 2 is a second preferred embodiment of the present invention 200 showing a stand-alone control unit, embodiment for production manufacture, based on electronic and microprocessor design. The components of FIG. 2 will now be described.

Referring to FIG. 2, component 210 is a wire connecting from the 24 Vac power supply terminal 230, of the air conditioning system to the 24 Vac power input terminal 224, inside the control enclosure 223. Component 211 is a wire connecting from the common power supply terminal 231, of the air conditioning system to the common input terminal 225, inside the control enclosure 223. Component 212, is a wire connecting from the thermostat heat control terminal 232, of the air conditioning system to the heat input terminal 226, inside the control enclosure 223. Component 213, is a wire connecting from the thermostat or humidistat fan control terminal 233, to the fan input terminal 227, inside the control enclosure 223. Component 214, is a wire connecting from the fan output terminal 228, inside the control enclosure 223, to the fan relay terminal 234, of the air conditioning system air distribution fan. Component 215 is a wire connecting from the outside air damper recycling control terminal 229, inside the control enclosure 223, to the outside air damper power input terminal 235. Component 220 is a light emitting diode (LED), or liquid crystal display, or other indicating means, that is energized upon power application to both the power supply input terminal 224, and the common input terminal 225. Component 221 is a LED, or liquid crystal display, or other indicating means, that is energized when the fan output terminal 228, is energized by the control for recycling operation only. Component 222 is a LED, or liquid crystal display, or other indicating means, that is energized when the outside air damper recycling control terminal 229, is energized. Component 217 can be a manually activated rotary switch or microprocessor equivalent input, to allow selection of the fan recycling control OFF delay time period, whereby, this delay time period begins at the end of the last operation of the air distribution fan or the last operation of the heating apparatus of the air conditioning system. Component 218 can be a manually activated rotary switch or microprocessor equivalent input, to allow selection of the fan recycling control ON delay time period, whereby, this delay time period begins at the end of the said OFF delay time period. Component 219 can be a manually activated rotary switch or microprocessor equivalent input, to allow selection of the outside air damper cycle time period, whereby, the cycle time period refers to the time that the damper output terminal 229, will cycle between, first energized, then de-energized, and so on, for as long as the fan output terminal 228, is energized. Component 216 is an on/off switch, or microprocessor equivalent input, that, when in the on position, allows the fan recycling control and the outside air damper recycling control to operate, and, when in the off position, disables the fan recycling control and the outside air damper recycling control operation. Regardless of the position of on/off switch 216, a fan control signal at fan input terminal 227, from a thermostat or humidistat, always passes through to the fan output terminal 228. Control enclosure 223, contains a printed circuit board with circuit components including a microprocessor to receive the control inputs, execute the required control logic, and produce the control outputs.

The operation of the components of FIG. 2 will now be described. Referring to FIG. 2, the present invention is wired in series between the thermostat or humidistat fan control terminal 233, and the fan relay terminal 234, of the air conditioning system air distribution fan, and the present invention is wired in parallel with the thermostat heat control terminal 232. When the fan control input terminal 227, is energized, the fan control output terminal 228, is energized, and the internal time clock of the microprocessor is reset. When the thermostat heat input control terminal 226, is energized, the internal time clock of the microprocessor is reset. When the fan control input terminal 227, is de-energized, the fan control output terminal 228, is de-energized, and the internal time clock of the microprocessor begins to record elapsed FAN OFF time. If the elapsed FAN OFF time equals the fan recycling FAN OFF time, set by switch 217, then the fan output control terminal 228, is energized, and the internal time clock of the microprocessor begins to record FAN ON elapsed time. If the elapsed FAN ON time equals the fan recycling FAN ON time, set by switch 218, then the fan output control terminal 228, is de-energized, and the internal time clock of the microprocessor begins to record elapsed FAN OFF time, and so on, until either the fan control input terminal 227, or the thermostat heat control input terminal 226, is energized, at which time the fan recycling process is interrupted. When the fan output control terminal 228, is energized, the outside air damper recycling control output terminal 229, is energized, and the microprocessor internal time clock begins to record the outside air damper elapsed open time. If the outside air damper elapsed open time equals the outside air damper cycle time, set by switch 219, then the outside air damper recycling control output terminal 229, is de-energized, and the microprocessor internal time clock begins to record the outside air damper elapsed closed time. If the outside air damper elapsed closed time equals the outside air damper cycle time, set by switch 219, then the outside air damper recycling control output terminal 229, is energized, and the microprocessor internal time clock begins to record the outside air damper elapsed open time, and so on, until the fan control output terminal 228, is de-energized, at which time the outdoor air damper control output terminal 229, is de-energized.

Third Embodiment

Figure 3:
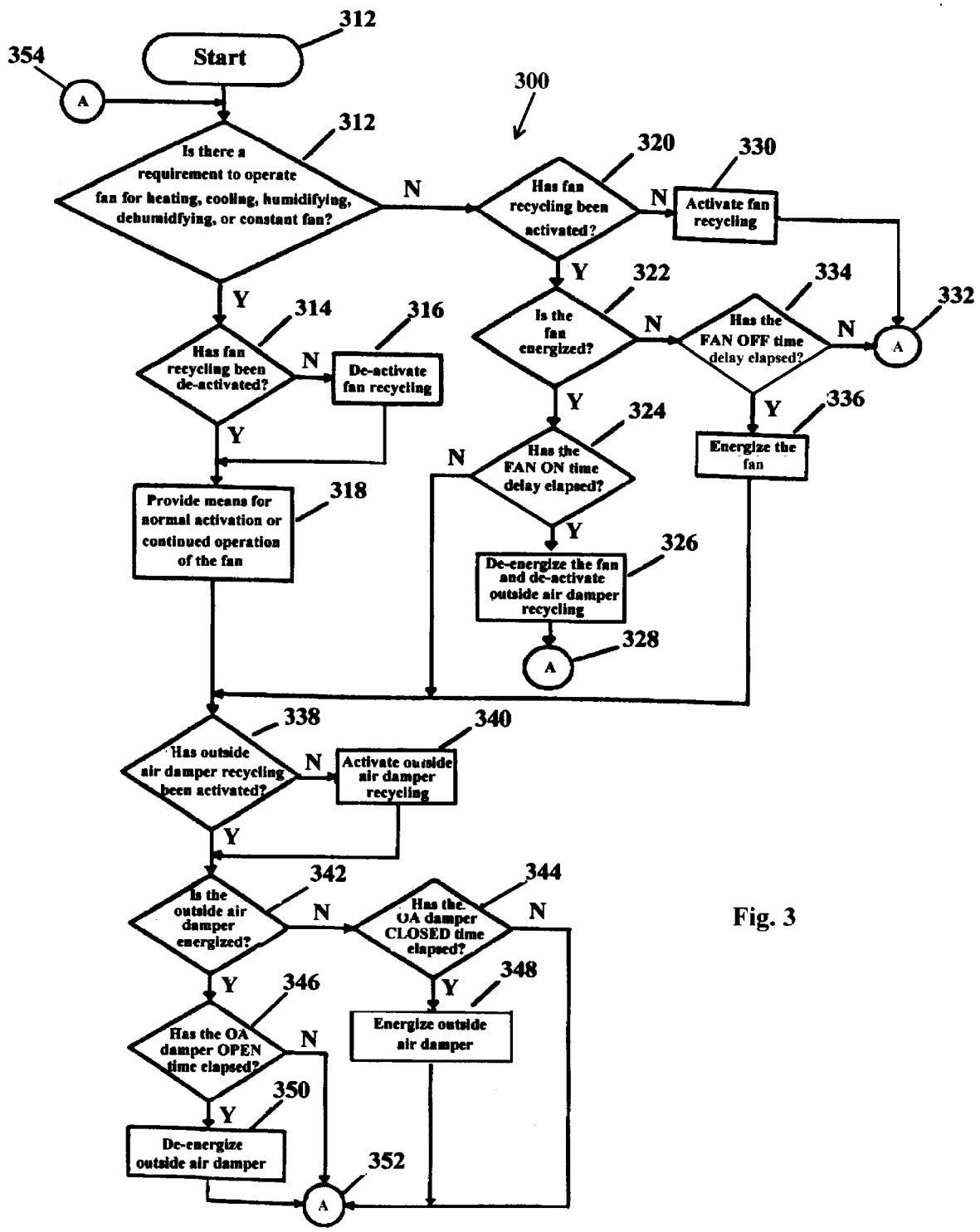
FIG. 3 is a third embodiment algorithm incorporating the fan recycling control and outside air damper recycling control functions of FIGS. 1–2 for use with a microprocessor based thermostat.

FIG. 3 is an algorithm of steps for integrating the fan recycling control and outside air damper recycling control functions of FIG. 1 and FIG. 2 into a microprocessor based thermostat. The algorithm of FIG. 3 will now be described.

The algorithm starts at 310. At 312 the program checks if the thermostat is calling for heating, cooling, humidifying, dehumidifying, or constant fan operation. If any of those modes are active, the program goes to 314 where it checks if fan recycling has been de-activated. If it has not, the program goes to 316 where fan recycling is de-activated, if it has, the program goes to 318 where the thermostat provides means for normal activation or continued operation of the air distribution fan. If the heating, cooling, humidifying, dehumidifying, or constant fan modes are not active, the program goes to 320 where it checks if fan recycling has been activated. If it has, the program goes to 322 where it checks if the air distribution fan is energized. If fan recycling has not been activated, the program goes to 330 where fan recycling is activated, whereby fan recycling activation starts with the FAN OFF time delay, then the program loops back to 354 through 332. If the air distribution fan is energized, the program goes to 324 where it checks if the FAN ON time delay has elapsed. If it has, the program goes to 326 where the fan is de-energized and the outside air damper recycling is de-activated, if it has not, the program goes to 338 where it checks if the outside air damper recycling has been activated. If the air distribution fan is not energized, the program goes to 334 where it checks if the FAN OFF time delay has elapsed. If it has, the program goes to 336 where it energizes the air distribution fan, if it has not, the program loops back to 354 through 332. If outside air damper recycling has been activated, the program goes to 342 where it checks if the outside air damper is energized. If outside air damper recycling has not been activated, the program goes to 340 where it activates outside air damper recycling, whereby the outside air damper recycling starts with the damper OPEN time. If the outside air damper is energized, the program goes to 346 where it checks if the outside air damper OPEN time has elapsed. If it has, the program goes to 350 where it de-energizes the outside air damper, then loops back to 354 through 352, if it has not, the program loops back to 354 through 352. If the outside air damper is not energized, the program goes to 344 where it checks if the outside air damper CLOSED time has elapsed. If it has, the program goes to 348 where it energizes the outside air damper, then loops back to 354 through 352, if it has not, the program loops back to 354 through 352.

Although the algorithm of FIG. 3 describes a particular flow of logic, other logic paths may be used to accomplish the same function.

Fourth Embodiment

Figure 4:
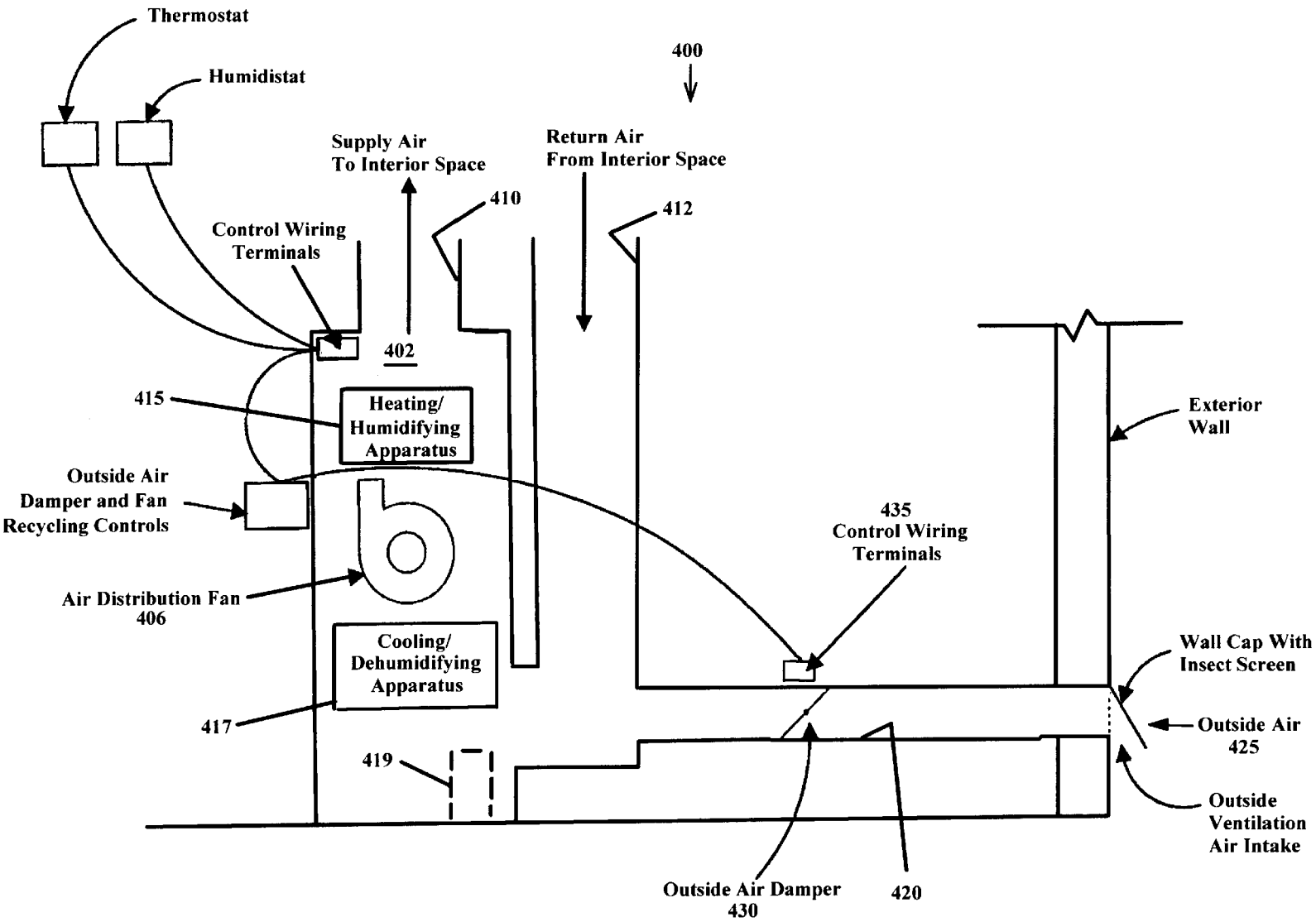
FIG. 4 is an exterior view of an air conditioning system with recycling controls for the fan and the damper along with an outside air damper.

FIG. 4 is a fourth embodiment schematic of an air conditioning system 400 showing an air handling unit 402 with an air distribution fan 406, a supply air duct 410 delivering air to the interior space, a return air duct returning air from the interior space to the air distribution fan 412, a heating and humidifying apparatus 415, a cooling and dehumidifying apparatus 417, and an air cleaning apparatus 419. Also shown in FIG. 4, is an outside air duct 420 connecting between outside to the return air side of the air distribution fan, for the purpose of drawing in outside ventilation air 425, an outside air damper 430 in the duct with control wiring 435. Also shown in FIG. 4, is a thermostat 452, a humidistat 454, a fan recycling control, an outside air damper recycling control 458, that correspond to the components and operation of the preceding figures.

Fifth Embodiment

Figure 5:
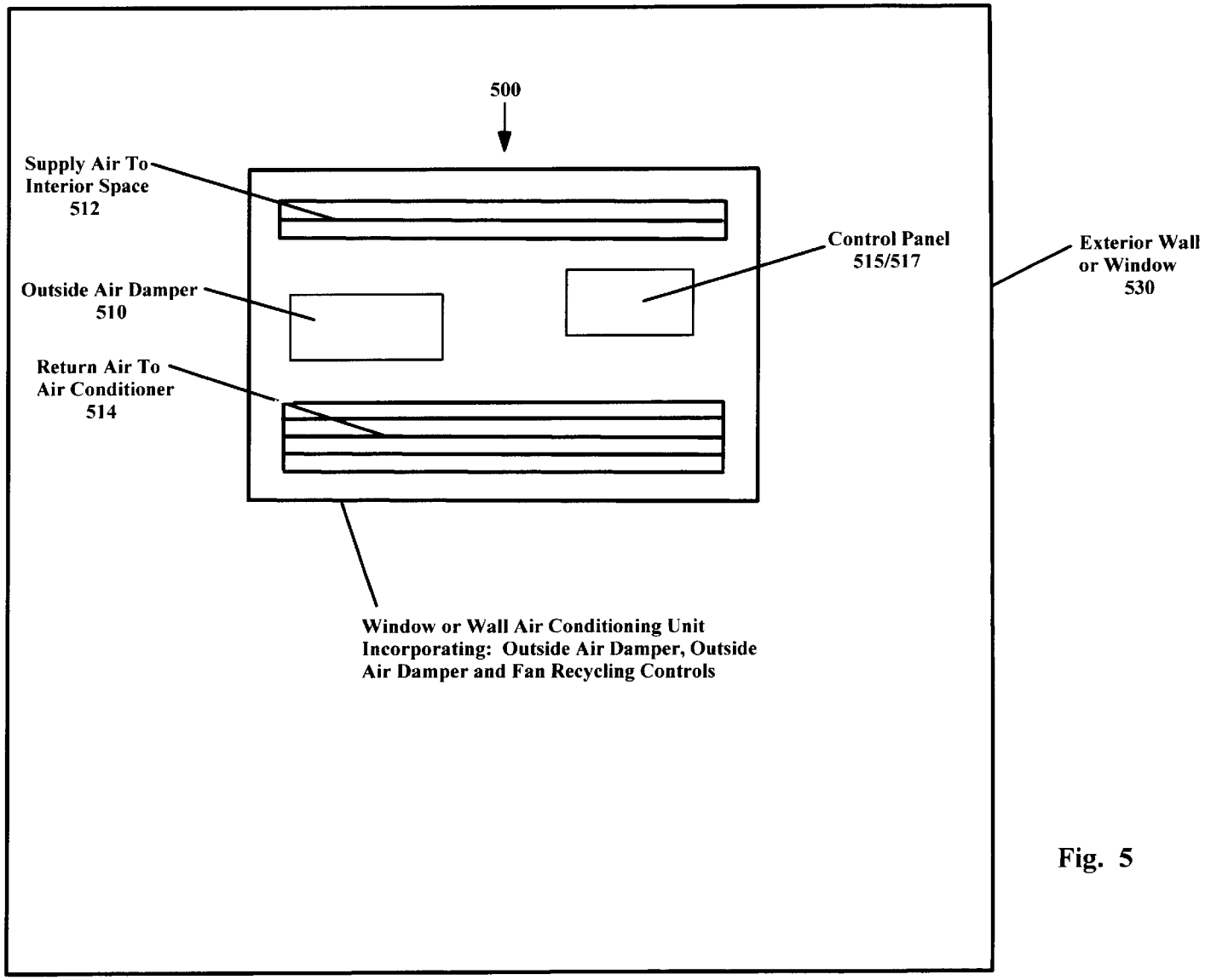
FIG. 5 is a external view of a window/wall air conditioning unit incorporating the novel recycling controls for a fan and outside air damper.

FIG. 5 is a fifth embodiment view of the face of a window or wall air conditioning system 500 such as but not limited to a Carrier with incorporated outside air damper 510, supply air 512, return air 514, fan recycling control 525, and outside air damper control 527, where the system is mounted over an existing window/wall opening 530. While the invention has been described, disclosed, illustrated and shown in various terms of certain embodiments or modifications which it has presumed in practice, the scope of the invention is not intended to be, nor should it be deemed to be, limited thereby and such other modifications or embodiments or embodiments as may be suggested by the teachings herein are particularly reserved especially as they fall within the breadth and scope of the claims here appended.

I claim:

1. An outside air damper recycling control for an air conditioning system, comprising:

an air conditioning system having a fan to distribute conditioned air in an interior space;

a damper for connecting and disconnecting outside air to the interior space; and a recycle means dependent upon the operating time of the fan for controlling the damper.

2. The recycling control of claim 1, further comprising:

means for controlling both the air conditioning system and the fan.

3. The recycling control of claim 2, further comprising:

a second recycle means for operating the fan dependent on a preselected delay time from the deactivating of air conditioning modes.

4. The recycling control of claim 1, wherein the air conditioning system includes at least one of:

a cooling means, a heating means, a humidifying means, a dehumidifying means, and an air cleaning means.

5. The recycling control of claim 1, wherein the air conditioning system includes:

a central air conditioning system.

6. The recycling control of claim 1, wherein the air conditioning system is at least one of:

a window unit and a wall unit.

7. The recycling control of claim 1, wherein the damper includes:

a motorized control to open and close the damper.

8. A method of mixing air in an interior space when not conditioning the air by an air conditioning system, the system having an outside air damper for opening the interior space to outside air, comprising the steps of:

deactivating air conditioning modes of an air conditioning system;

activating a fan and outside damper after a preselected delay time from the deactivating of the air conditioning modes; and periodically closing and opening the damper dependent upon the operating time of the fan.

9. The method of claim 8, further includes:

selecting the open and close times of the damper.

10. The method of claim 7, wherein the air conditioning system includes at least one of:

a cooling means, a heating means, a humidifying means, a dehumidifying means, and an air cleaning means.

11. The method of claim 7, wherein the air conditioning system is at least one of:

a window unit and a wall unit.

12. A fan recycling control and an outside air damper recycling control for an air conditioning system, comprising:

an air conditioning system having air conditioning apparatus including at least one of:

a heating apparatus, a cooling apparatus, a humidifying apparatus, a dehumidifying apparatus, and an air cleaning apparatus for providing conditioned air;

a fan to distribute conditioned air to an interior space; at least one of:

a thermostat and humidistat for activating and deactivating said air conditioning apparatus and the fan;

a fan recycling control means for periodically activating and deactivating only said fan in said air conditioning system in order to operate said fan for a first selectable time period a fan recycling control means for periodically activating and deactivating only said fan in said air conditioning system in order to operate said fan for a first selectable time period after a second selectable time period from the end of the last operation of said fan, wherein the last operation of said fan includes the last operation of said air conditioning system, or the last fan operation initiated by the fan recycling control;

an outside air duct connecting outside of a building to said fan;

an outside air damper in the outside air duct; and an outside air damper recycling control that opens the outside air damper each time the fan begins to operate, and for as long as said fan continued to operate, cycles, periodically closes and opens, the outside air damper based on selectable time periods since the outside air damper was last opened and closed, and closes the outside air damper at the end of each operation of said fan.

13. The recycling controls of claim 12, wherein the air conditioning system includes:

a central air conditioning system.

14. The recycling controls of claim 12, wherein the air conditioning system includes at least one of:

a window unit and a wall unit.

* * * * *

UNITED STATES PATENT AND TRADEMARK OFFICE

CERTIFICATE OF CORRECTION

PATENT NO. : 5,881,806
APPLICATION NO. : 08/912664
DATED : March 16, 1999
INVENTOR(S) : Armin Rudd It is certified that error appears in the above-identified patent and that said Letters Patent is hereby corrected as shown below:

Page 7, Column 3, Line 48 “with electric beat” should read -- with electric heat--

Page 11, column 9, line 39, Claim 10 “The method of claim 7,” should read --The method of claim 8,--

Page 11, column 9, line 43, Claim 11 “The method of claim 7,” should read --The method of claim 8,--

Signed and Sealed this

Second Day of January, 2007

JON W. DUDAS
*Director of the United States Patent and Trademark Office*